United States Patent [19]

Ihara

[11] Patent Number: 4,844,472

[45] Date of Patent: Jul. 4, 1989

[54] GOLF BALL

[75] Inventor: Keisuke Ihara, Tokyo, Japan

[73] Assignee: Bridgestone Corporation, Tokyo, Japan

[21] Appl. No.: 84,765

[22] Filed: Aug. 13, 1987

[30] Foreign Application Priority Data

Aug. 21, 1986 [JP] Japan ..... 61-194082

[51] Int. Cl.[4] ..... A63B 37/12

[52] U.S. Cl. ..... 273/232; 40/327

[58] Field of Search ..... 273/232

[56] References Cited

U.S. PATENT DOCUMENTS 4,653,758 3/1987 Solheim ..... 273/232

*Primary Examiner*—George J. Marlo

*Attorney, Agent, or Firm*—Sughrue, Mion, Zinn, Macpeak & Seas

[57] ABSTRACT

A golf ball has a spherical surface inscribed or circumscribed with a regular icosahedron, and dimples (3) formed in the spherical surface. The golf ball has a first great circle (5) including a side of a spherical triangle (4*a*) projected onto the spherical surface and another great circle including a line segment drawn from a midpoint (4*b*) of the side to its diagonal point (4*c*) depicted on the spherical surface. Dimples (3) are symmetrically arranged in the spherical triangle with respect to each of 15 great circles as a symmetry axis.

3 Claims, 2 Drawing Sheets

GOLF BALL

BACKGROUND OF THE INVENTION

1. Field of the Invention

This invention relates to golf balls, and more particularly to an arrangement of dimples in the golf ball which can considerably improve flight performance.

2. Related Art Statement

In order to equally arrange dimples on the spherical surface of the golf ball as far as possible, it is generally practised to design the dimple arrangement on the basis of regular dodecahedron or regular icosahedron as disclosed in Japanese Patent laid open No. 49-52,029, British Pat. No. 377,354 and U.S. Pat. No. 4,560,168. In these conventional techniques, considering a spherical triangle obtained by projecting each of equilateral triangles constituting the regular icosahedron onto a spherical surface inscribed or circumscribed with the regular icosahedron, a great circle is formed about a line segment connecting each vertex or midpoint of the spherical triangle to a center of a sphere as a center axis, while the arrangement of dimples in the spherical triangle is determined in connection with great circles passing through the spherical triangle.

In order to enhance the aerodynamic performance of the golf ball, it is generally required to make the number of great circles as large as possible, and it is demanded that the dimple patterns are symmetrized with each other with respect to each of the great circles, whereby the lift and drag of the flying golf ball with translational and rotational motions are made substantially equal at both sides thereof with respect to the respective great circle and a probability of the golf ball rotating in the same direction as in the extending direction of the great circle. In this connection, when the great circle is depicted around a center axis connecting each vertex or midpoint of spherical pentagon or spherical triangle to the center of the sphere as in the conventional techniques, the number of great circles is 10 at maximum and it is substantially impossible to form more than 10 great circles. And also, portions of the spherical pentagon or spherical triangle divided by each great circle are not symmetrical with respect to the great circle at the position of great circle path, and hence the symmetry of dimple pattern with respect to the great circle can not be obtained. In this case, even if the golf ball flies in the extending direction of the great circle while spinning, it is subjected to different aerodynamic actions at both side portions bordering the great circle, and consequently there is a high risk of causing precession of the flying ball to result in the reduction of flying distance, the turning and the like.

For instance, this fact will be explained based on the regular icosahedron. Considering a vertex of a regular triangle t as a pole p as shown in FIG. 2, the depicted great circle corresponds to an equatorial line e, so that the phase shift of 36 degree is caused in the circumferential direction of the equatorial line e in order to make portions of the triangles t divided by the equatorial line e symmetrical. While, considering a center of regular triangle t as a pole as shown in FIG. 3, the phase shift of 60 degree is caused in the circumferential direction of the equatorial line e as a great circle. On the other hand, when considering a vertex of regular pentagon as a pole in the regular dodecahedron, the phase shift of 60 degree is also caused in the circumferential direction of the great circle. Moreover, when a center of regular pentagon is considered as a pole, the phase shift is the same as in the case of taking the vertex of the regular triangle in the regular icosahedron according to dual theory.

SUMMARY OF THE INVENTION

It is an object of the invention to advantageously solve the aforementioned problems of the conventional techniques and to provide golf balls which can effectively prevent the occurrence of precession and sufficiently enhance the aerodynamic uniformity by increasing the number of great circles as far as possible and symmetrizing the dimple pattern with respect to each great circle.

According to the invention, there is the provision of a golf ball having a spherical surface inscribed or circumscribed with a regular icosahedron and a plurality of dimples formed in the spherical surface, characterized in that a great circle including each side of spherical triangle projected from a regular triangle constituting said regular icosahedron onto said spherical surface and a great circle including a line segment drawn from a midpoint of said side of its diagonal point are depicted on said spherical surface, and said dimples are symmetrically arranged with respect to each of said great circles as a symmetry axis in said spherical triangle.

In the golf ball according to the invention, the great circle including each side of the spherical triangle and the great circle including the line segment drawn from the midpoint of each side to its diagonal point are depicted on the spherical surface, whereby the total number of great circles can be increased to 15, and consequently the probability of flying the golf ball in the extending direction of the great circle with rotating can be raised as compared with the conventional technique.

Furthermore, the spherical triangles divided by the respective great circle and portions of the spherical triangle divided by the respective great circle are symmetrical with respect to the great circle, and the dimples are symmetrically and evenly arranged in the spherical triangle with respect to the respective great circle as a symmetry axis, so that the golf ball is substantially subjected to equal aerodynamic action at both side portions bordering the respective great circle. Consequently, the aerodynamic uniformity of the golf ball is sufficiently improved as compared with the conventional technique, and also the flight performance characteristic such as directional property, flying distance and so on as well as the scattering of flight performance resulting from the difference in the hitting position of the ball are considerably improved to effectively prevent the occurrence of precession.

DESCRIPTION OF THE PREFERRED EMBODIMENTS

Figure 1:
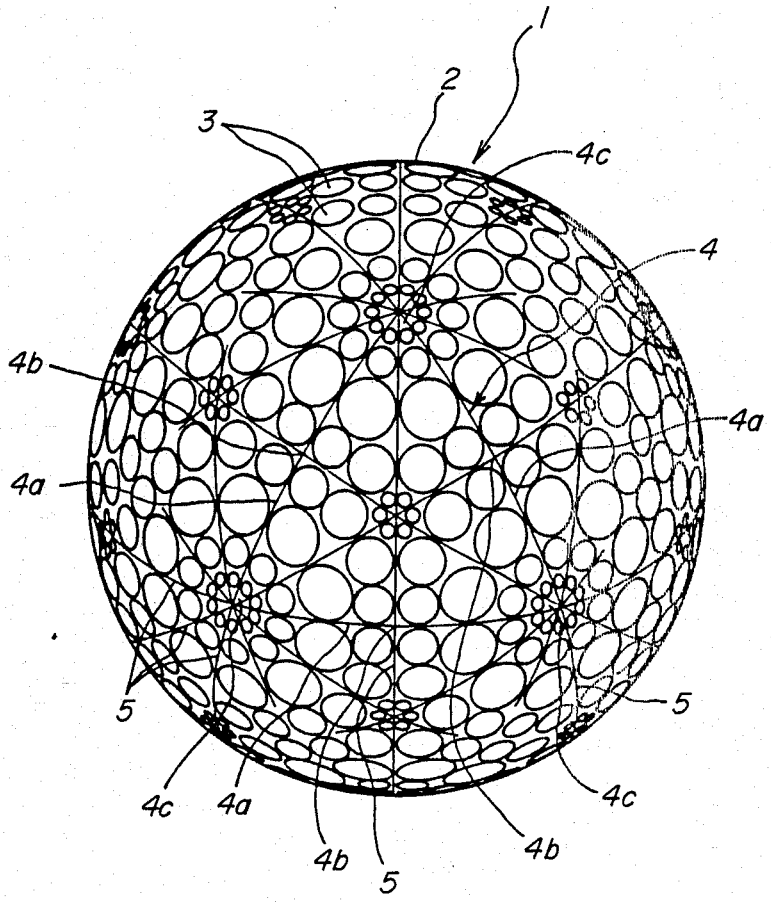
FIG. 1 is an elevational view of an embodiment of the golf ball according to the invention.

Referring to FIG. 1, numeral 1 is a golf ball according to the invention.

Figure 2:
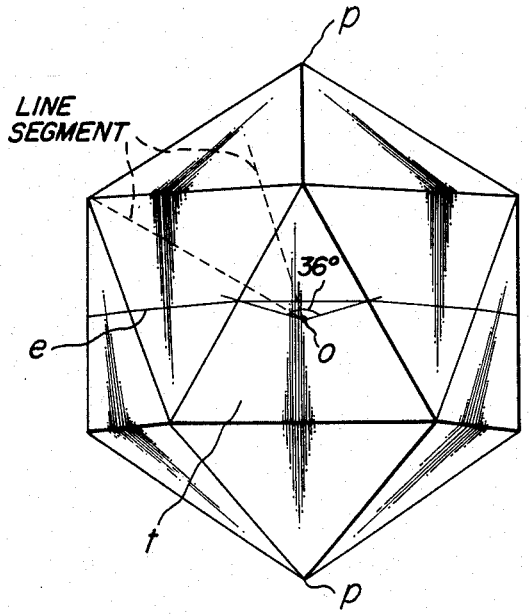
FIG 2 PRIOR ART
FIGS. 2 and 3 are diagrammatic views illustrating the formation of great circle according to the conventional technique, respectively.
Figure 3:
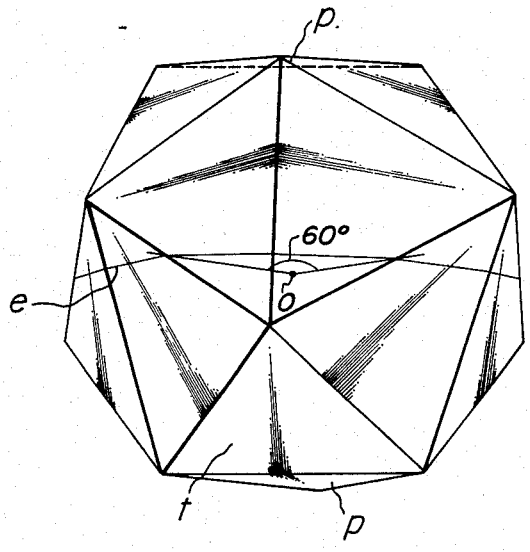
FIG 3 PRIOR ART

As shown in FIG. 1, the golf ball 1 is constructed by evenly arranging a plurality of dimples 3 in a spherical surface 2 inscribed or circumscribed with a regular icosahedron shown in FIGS. 2 and 3.

The arrangement of such dimples is determined in connection with a spherical triangle 4 formed by projecting the regular triangle of the regular icosahedron onto the spherical surface as follows.

In each of spherical triangles 4 projected onto the spherical surface, a great circle is depicted around a center axis connecting a midpoint 4*b* of each side 4*a* to a center of the sphere in form of an intersection of a plane perpendicular to the center axis at the position of spherical center with the spherical surface. Thus, great circles 5 including each side 4*a* of the spherical triangle 4 and great circles 5 including a line segment drawn from the midpoint 4*b* of the side 4*a* to its diagonal point 4*c* are formed on the spherical surface.

In this way, fifteen great circles 5 in total are formed on the spherical surface. Further, each of the spherical triangles 4 is symmetrically divided into two equal portions by the great circle passing the spherical triangle.

When an area enclosed by a portion of the side of the spherical triangle 4 and portions of two great circles passing through the center of the spherical triangle 4 and crossing with the side portion is considered as a basic triangle, each of the spherical triangles 4 includes six basic triangle areas, which are symmetrical with each other with respect to each of the great circles 5 in the spherical triangle 4 as a symmetry axis.

A plurality of dimples are arranged in each of these basic triangle areas. In the illustrated embodiment, six large and small dimples 3 each having a circle in plane shape are evenly arranged in the basic triangle area. Therefore, these dimple groups are symmetrical with each other with respect to anyone of the great circles 5.

Moreover, the plane shape of the dimple 3 may be curved shape such as ellipse, oblong and so on or polygonal shape such as triangle, rectangle and so on insofar as the dimples are evenly arranged in the basic triangle area. And also, the number of dimples in one dimple group may be properly increased or decreased, if necessary.

The total depression volume of the dimples 3 is preferable to be about 0.8~1.1% of the volume of the sphere before the formation of dimple.

Since the golf ball 1 of the above construction has fifteen great circles 5 in total, if it is intended to hit the ball, the probability of driving the ball in the extending direction of the great circle with rotating can considerably be raised irrespectively of the hitting position, which is particularly effective in such a striking that the hitting position of the ball cannot freely be selected. On the other hand, when the hitting position of the ball can freely be selected in the striking or putting, since a large number of great circles are existent in the ball, it is very easy to search any one of the great circles to determine the hitting position of the ball.

In the golf ball according to the invention, each of the spherical triangles 4 is symmetrically divided into two equal portions by any one of the great circles 5 passing this spherical triangle and the dimple groups are arranged so as to be symmetrical with respect to each of the great circles 5, so that the aerodynamic action to the spinning ball 1 flying in the extending direction of the great circle 5 becomes substantially uniform at both side portions bordering the great circle, whereby the occurrence of precession exerting on the flight performance of the ball is sufficiently prevented.

In the illustrated embodiment, the dimples are formed so as to avoid all of the great circles. However, insofar as all dimples may be shaped into a desired pattern by molding, it is possible to form the dimples on one or more of the great circles.

As mentioned above, according to the invention, the number of great circles are 15 and also the dimple patterns at both side portions bordering the great circle are symmetrical with respect to this great circle, so that the aerodynamic uniformity of the golf ball is largely improved to sufficiently improve the flight performances and effectively reduce the scattering of the flight performance, and further the precession exerting on the flight performance can advantageously be removed.

What is claimed is:

1. A golf ball comprising; a spherical surface inscribed or circumscribed with a regular icosahedron and a plurality of dimples formed in the spherical surface, a first series of great circles each including each side of a spherical triangle projected from a regular triangle constituting said regular icosahedron onto said spherical surface and a second series of great circles each including a line segment drawn from a midpoint of said side of said spherical surface to its diagonal point are depicted on said spherical surface, and said dimples symmetrically arranged with respect to each of said first and second series of great circles as a symmetry axis in said spherical triangle and paths of said first and second series of great circles on said spherical surface not passing through any of said dimples.

2. The golf ball according to claim 1, wherein said first and second series of great circles are 15 great circles in total.

3. The golf ball according to claim 1, wherein said dimples have a total depression volume corresponding to 0.8~1.1% of a volume of a sphere of said ball before the formation of dimple.

* * * * *